US007527029B2

(12) United States Patent
Yasui

(10) Patent No.: US 7,527,029 B2
(45) Date of Patent: May 5, 2009

(54) CONTROLLER FOR PLANT USING PWM ALGORITHM

(75) Inventor: Yuji Yasui, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 123 days.

(21) Appl. No.: 11/509,091

(22) Filed: Aug. 24, 2006

(65) Prior Publication Data

US 2007/0062471 A1 Mar. 22, 2007

(30) Foreign Application Priority Data

Sep. 13, 2005 (JP) ..... 2005-265657

(51) Int. Cl.
*F01L 1/34* (2006.01)

(52) U.S. Cl. ..... 123/90.15; 123/90.17; 123/90.16

(58) Field of Classification Search ..... 123/90.15, 123/90.16, 90.17, 90.31
See application file for complete search history.

(56) References Cited

U.S. PATENT DOCUMENTS 5,363,817 A * 11/1994 Ikeda et al. ..... 123/90.15
2003/0107435 A1* 6/2003 Gu ..... 330/149

FOREIGN PATENT DOCUMENTS

JP 2001-152885 A 6/2001
JP 2005-011036 A 1/2005

* cited by examiner

*Primary Examiner*—Zelalem Eshete
(74) *Attorney, Agent, or Firm*—Arent Fox LLP

(57) ABSTRACT

A controller for a plant that can compensate for non-linear property and reduce oscillation of output of a controlled object even when the controlled object has high non-linear property is provided. The present invention provides a controller for a plant that uses PWM algorithm. The device calculates provisional control input for controlling output of the plant at a target value, and divides the provisional control input into a plurality of components. The controller PWM-modulates at least one of the plurality of components, and sums the PWM-modulated component and other components to produce a control input to the plant. The controller minimizes variations in input while maintaining the ability of PWM modulation to compensate for non-linear property of the plant.

17 Claims, 13 Drawing Sheets

CONTROLLER FOR PLANT USING PWM ALGORITHM

BACKGROUND OF THE INVENTION

1. Field of the Invention

The present invention relates to a feedback control scheme for a plant. More particularly, the present invention relates to control of a variable lift system, control of a variable phase system, and air-fuel ratio control of an internal combustion engine.

2. Description of the Related Art

When a plant has a strong non-linear property, a general linear feedback controller such as PD and PID has problems in following ability and stability, and thus hardly realizes high-precision control. For example, high-precision feedback control is hard to achieve for a variable lift system of an internal combustion engine because it has a large friction and has a non-linear property such as a hysteresis property relative to increase/decrease of lift amount. Similarly, a variable phase system and/or an air-fuel ratio control system for an internal combustion engine and an actuator control system for an automatic transmission have a strong non-linearity.

Control of an internal combustion engine is based on realization of highly precise operations of a plurality of components. High precision is required as to operation stability and following ability for such components with a strong non-linear property mentioned above. Accordingly, a control technique applicable to plants having a strong non-linear property is needed.

As a control method for compensating for non-linear property of a plant, sliding mode control with two-degree-of-freedom has been proposed (see Patent Document 1, for example). When controlling a controlled object that has a non-linear property such as friction and hysteresis property, sliding mode control with two-degree-of-freedom compensates for the non-linear property by introducing non-linear input capable of controlling output of the controlled object to a target value with high precision and high response. As the method can specify an error convergence property separately in terms of responsiveness of following a target value and disturbance, it exhibits excellent overshoot suppression capability when the target value is changed.

Patent Document 2 discloses a control method that adds dither input to a sliding mode controller. This method uses dither input to correct a control amount that is produced from the sliding mode controller for feedback-controlling of a plant to a target value. This process compensates for degradation of controllability due to a non-linear property of a plant such as a friction property.

[Patent Document]: Japanese Patent Application Publication (JPAP) No. 2005-11036

[Patent Document]: JPAP No. 2001-152885

SUMMARY OF THE INVENTION

In the case of sliding mode control with two-degree-of-freedom as described in Patent Document 1, however, the output of a plant may become oscillatory depending on a non-linear property of the plant. When non-linear property of the plant increases to some extent, amplitude of non-linear input has to be set large. Although this can realize reduction of overshoot property because of compensation of non-linear property, it makes output of a controlled object oscillatory.

The method described in Patent Document 2 has problems in following ability and stability of control. In the method of Patent Document 2, when switching function of a sliding mode controller with dither input exceeds a threshold value, dither input of a predetermined amplitude is added to a control amount. That is, since addition of dither input is stopped when the controlled object is coming close to a target value (i.e., switching function is below the threshold value), control becomes equivalent to normal feedback control. Consequently, behavior during feedback control is smoothed, but delay of following and occurrence of steady-state deviation are not reduced. In addition, oscillation can occur in the proximity of the target value if dither is also added when switching function is below the threshold value and amplitude of dither signal is increased in order to improve those problems.

There is a need for a control method that can compensate for non-linear property and suppress oscillation of output of a controlled object even when the controlled object has a high non-linear property.

The present invention provides a plant controller that uses pulse width modulation (PWM) algorithm. The controller includes means for calculating provisional control input for controlling output of the plant to a target value, means for dividing the provisional control input into a plurality of components, means for PWM-modulating at least one of the plurality of components, and means for summing the PWM-modulated component and other components to generate a control input to the plant.

According to the invention, variations in input may be minimized while maintaining the ability of PWM modulation of compensating for non-linear property of a plant. This can prevent output from becoming oscillatory and improve controllability even in a plant that has largely varying provisional control inputs.

According to an embodiment of the invention, the plurality of components resulting from division of provisional control input has a first component produced by filtering provisional control input and a second component, which is a difference between the provisional control input ant the first component and is within a predetermined absolute value range. The second component is PWM modulated.

This eliminates the need to set the amplitude of PWM modulation to encompass the variation range of provisional control input, so that compensation of non-linear property and reduction of oscillatory behavior of plant outputs can be done. In addition, since amplitude of a PWM-modulated component is minimized, control resolution is improved enabling suppression of minute variation of output, leading to enhanced controllability.

According to an embodiment of the invention, the first component resulting from division of provisional control input is limited such that variation amount lies within a predetermined range. This predetermined range is changed in accordance with variation amount of the target value. Thus, even when the target value varies largely, delay of following may be prevented and the ability to compensate for non-linear property may not be reduced.

According to an embodiment of the invention, the first component resulting from division of provisional control input is limited such that a variation amount lies within a predetermined range. The predetermined range is changed in accordance with variation amount of disturbance. Thus, even when a large disturbance such as an abrupt change in the number of engine rotations is applied and the provisional control input changes largely, delay of following may be suppressed and the ability to compensate for non-linear property may not be reduced.

According to an embodiment of the invention, means for PWM modulation offsets a component to be PWM-modulated in a predetermined direction and applies PWM modulation to the offset component. And it offsets the PWM-modulated component in the reverse direction again. This can reduce stead-state deviation of the plant output.

According to an embodiment of the invention, the controller using PWM algorithm can be applied to a variable lift system, variable phase system, air-fuel ratio control, or an automatic transmission for an internal combustion engine.

DETAILED DESCRIPTION OF THE PREFERRED EMBODIMENTS

Figure 1:
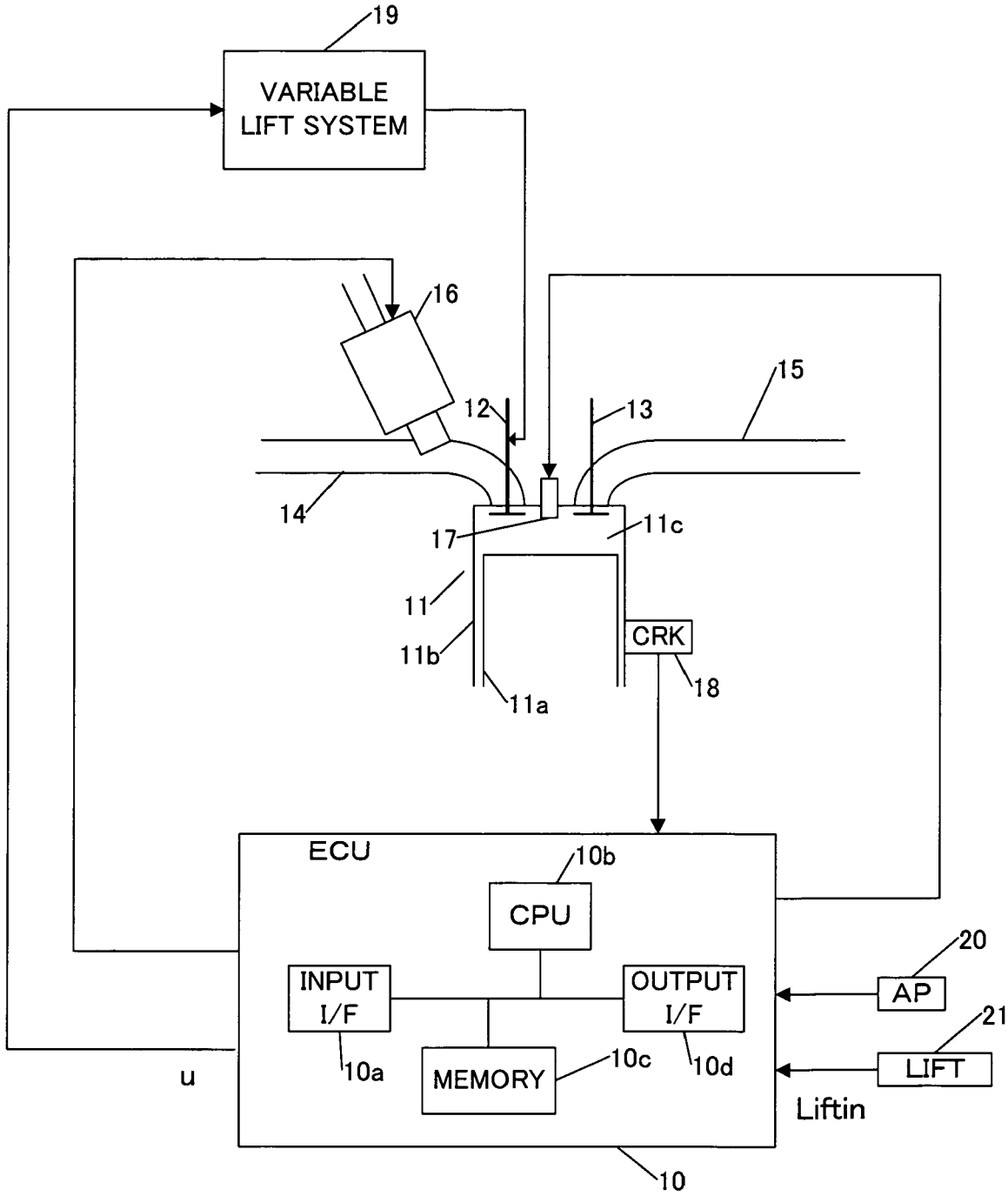
FIG. 1 generally illustrates the configuration of an internal combustion engine (hereinafter an "engine") and a controller according to an embodiment of the invention.

Embodiments of the invention will be described with reference to drawings. FIG. 1 generally illustrates the configuration of an internal combustion engine (hereinafter referred to as an "engine") and a controller according to an embodiment of the invention.

An electronic control unit (hereinafter referred to as an "ECU") 10 is a computer that includes an input interface 10*a* for receiving data from various portions of a vehicle, a CPU 10*b* for executing computation for controlling various portions of the vehicle, and a memory 10*c* including a read-only memory (ROM) and a random access memory (RAM). The ROM stores programs and various data for controlling various portions of the vehicle while the RAM provides a working space and temporary storage for the CPU. The controller also includes an output interface 10*d* for sending control signals to various portions of the vehicle.

A program for calculating control input to a variable lift system according to the invention and data and a table for use when the program is executed are stored in the ROM of memory 10*c*. The ROM may also be rewritable-ROM such as EEPROM. The RAM has a work area for computation by the CPU 10*b*, in which data from various portions of the vehicle and control signals to be sent to various portions of the vehicle are temporarily stored.

Various signals sent to the ECU 10 such as sensor output are passed to the input interface 10*a* to be converted from analog to digital. The CPU 10*b* processes converted digital signals according to the program stored in the memory 10*c* to generate control signals. The output interface 10*d* sends the control signals to various portions of the vehicle.

An engine 11 is a four-cylinder four-cycle engine, for example, and one of the cylinders is generally shown in the figure. The engine 11 is connected to an intake pipe 14 via an intake valve 12 and connected to an exhaust pipe 5 via an exhaust valve 13. A fuel injection valve 16 that injects fuel in accordance with control signals from the ECU 10 is provided in the intake pipe 14. A combustion chamber 11*c* has a spark plug 17 for producing sparks according to ignition timing signals from the ECU 10.

The engine 11 intakes air-fuel mixture comprising air taken in with the intake pipe 14 and fuel injected by the fuel injection valve 16 into a combustion chamber 11*c*, where the air-fuel mixture is combusted as a spark is produced by the ignition plug 17. The combustion increases the volume of the air-fuel mixture thereby pushing a piston 11*a* downward. The reciprocation of the piston 11*a* is transformed to rotational motion of a crank shaft (not shown). With a four-cycle engine, an engine cycle consists of intake, compression, combustion, and exhaust processes. The piston 11*a* makes two trips per cycle.

The engine 11 varies timing of opening/closing the intake valve 12 and the exhaust valve 13 in accordance with instructions from the ECU 10 to realize valve timing optimal for a drive condition.

The engine 11 has a crank angle sensor 18. The crank angle sensor 18 outputs CRK signal and TDC signals, which are pulse signals, to the ECU 10 along with rotation of the crank shaft (not shown).

CRK signal is a pulse signal that is output at a predetermined crank angle (e.g., every 30 degrees). The ECU 10 determines the number of rotation NE of the engine 11 in response to CRK (crank) signals. TDC signal is a pulse signal that is output at a crank angle when the piston 11*a* is at a TDC (top dead center) position.

An opening degree of the acceleration pedal (AP) sensor 20 is connected to the ECU 10. The AP sensor 20 detects the opening of the acceleration pedal and sends the output to the ECU 10.

The variable lift system 19 is a mechanism that can change the lift amount of the intake valve 12 in accordance with control signal u from the ECU 10. The maximum lift amount of the valve is determined based on the drive condition of the engine and/or a required driving force.

The variable lift system 19 can be realized with any known method. The variable lift system used in the embodiment consists of a cam, a lift variable link, an upper link, and a lower link, for example, and is capable of adjusting the maximum lift amount of the valve by changing the angle of the lower link by way of an actuator and the like. Details on the variable lift system can be found in Japanese Patent Application Publication No. 2004-036560, for example.

A lift amount sensor 21 is connected to the ECU 10. The lift amount sensor 21 detects the lift amount Liftin of the intake valve 12 and sends the output to the ECU 10. In this embodiment, lift amount Liftin is detected at a predetermined time interval (e.g., 5 ms).

Figure 2:
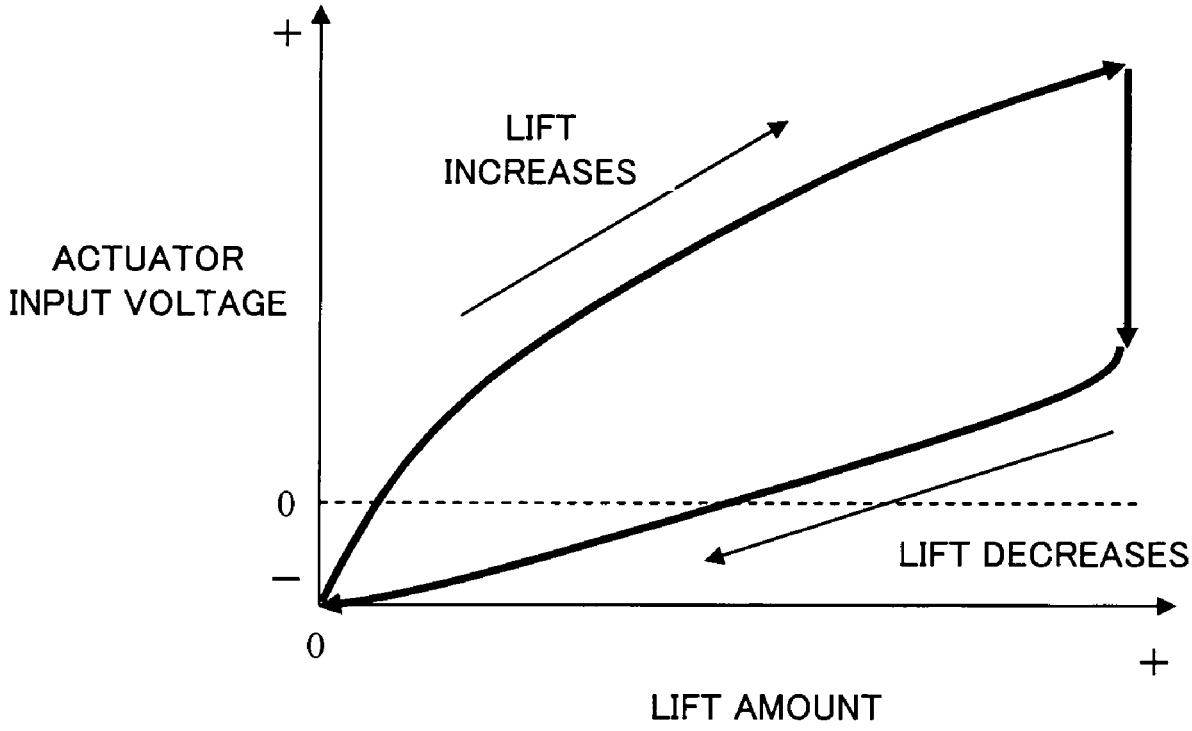
FIG. 2 illustrates hysteresis property of a variable lift system.

Referring to FIG. 2, the non-linear property of the variable lift system 19 will be described. The variable lift system 19 has a large friction and has a hysteresis property as illustrated in FIG. 2. The variable lift system 19 requires a large voltage for driving the actuator to change lift amount for increasing the lift amount. On the other hand, when decreasing the lift amount, voltage for driving the actuator is smaller than when increasing it.

In the variable lift system having the non-linear property, sliding mode control with two-degree-of-freedom method as discussed in Patent Document 1 may achieve a relatively fine control result relative to a target value when the non-linear property is small.

However, a variable lift system has a variation range of control input as large as ±10V and variation occurs rapidly. Compensation of such variation range would cause control input to oscillate and degrade the precision of control.

To solve this problem, in this embodiment, a portion of control input produced by a conventional control method such as a sliding mode control with two-degree-of-freedom is PWM-modulated to produce a control input u to the variable lift system 19. This scheme is hereinafter referred to as "bypass PWM algorithm".

Figure 3:
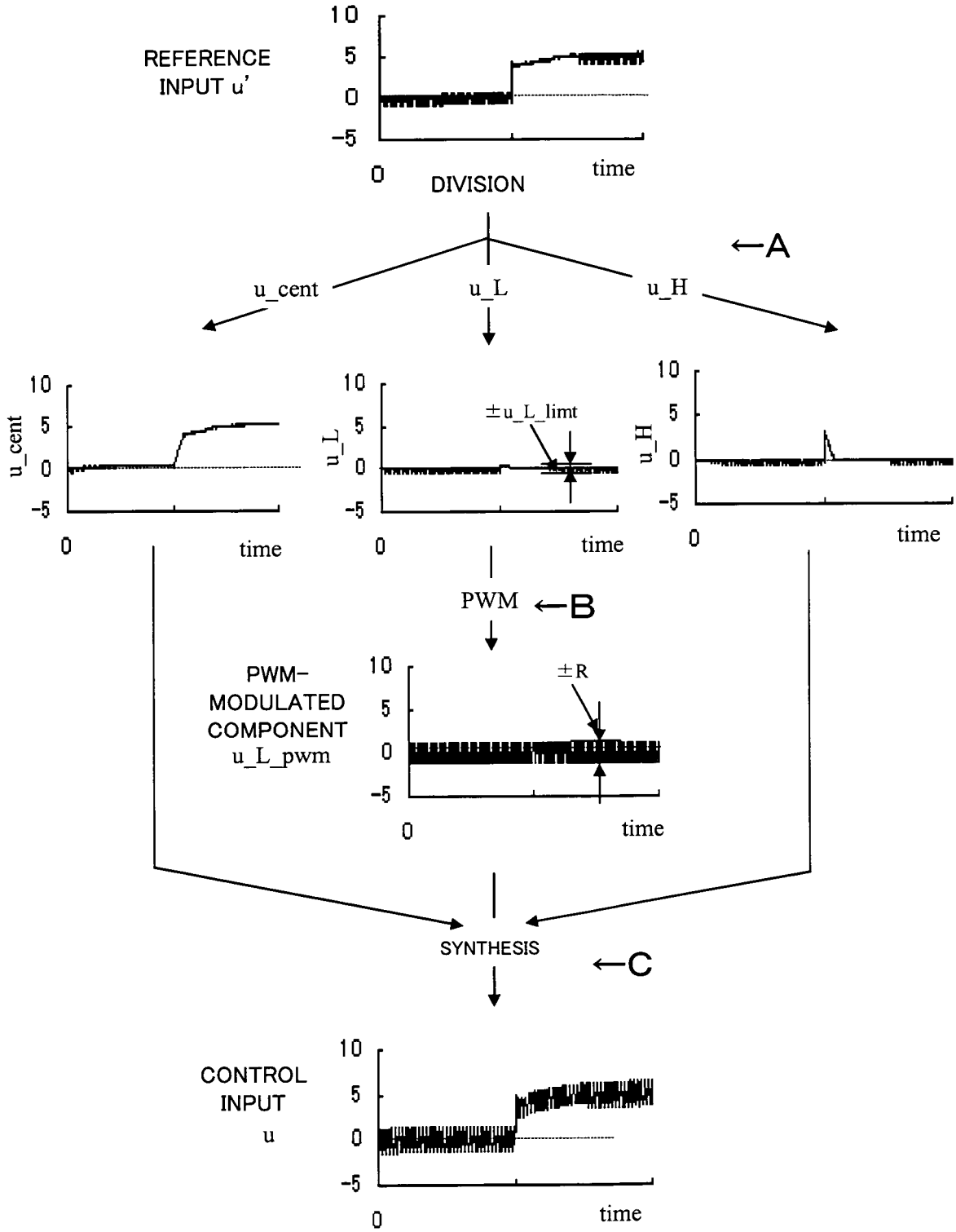
FIG. 3 generally illustrates bypass PWM algorithm according to the embodiment.

FIG. 3 generally illustrates the bypass PWM algorithm according to the embodiment. The bypass PWM algorithm first divides reference input u' from a controller into three components as indicated in the following formula (1) as illustrated by an arrow A in FIG. 3.

$$u'(k)=u_\mathrm{cent}(k)+u_L(k)+u_H(k) \tag{1}$$

where u_cent(k) represents the central value component of the variation range of the reference input, u_L(k) represents a small variation component which is variation from central value component u_cent(k) within a predetermined range, and u_H(k) represents a large variation component which is variation from u_cent(k) beyond the predetermined range.

The small variation component u_L(k) only is modulated by PWM algorithm to obtain a modulated component of the small variation component u_L_pwm(k) as illustrated by an arrow B in FIG. 3. Subsequently, the modulated component U_L_pwm(k) and other components are combined to produce control input u(k) by formula (2) as illustrated by an arrow C in FIG. 3.

$$u(k)=u_\mathrm{cent}(k)+u_L_pwm(k)+u_H(k) \tag{2}$$

Thus, a PWM signal of a small amplitude is produced for a control input in accordance with a global behaviour of the reference input u'. In this manner, the components of the control signal that has a large variation are saved as they are, and only the signal component from the remaining components that has an amplitude within a predetermined range are PWM-modulate. This scheme allows to compensate for the non-linear property, which is a property of the PWM algorithm, and enables generation of a control signal with suppressed vibration.

Figure 4:
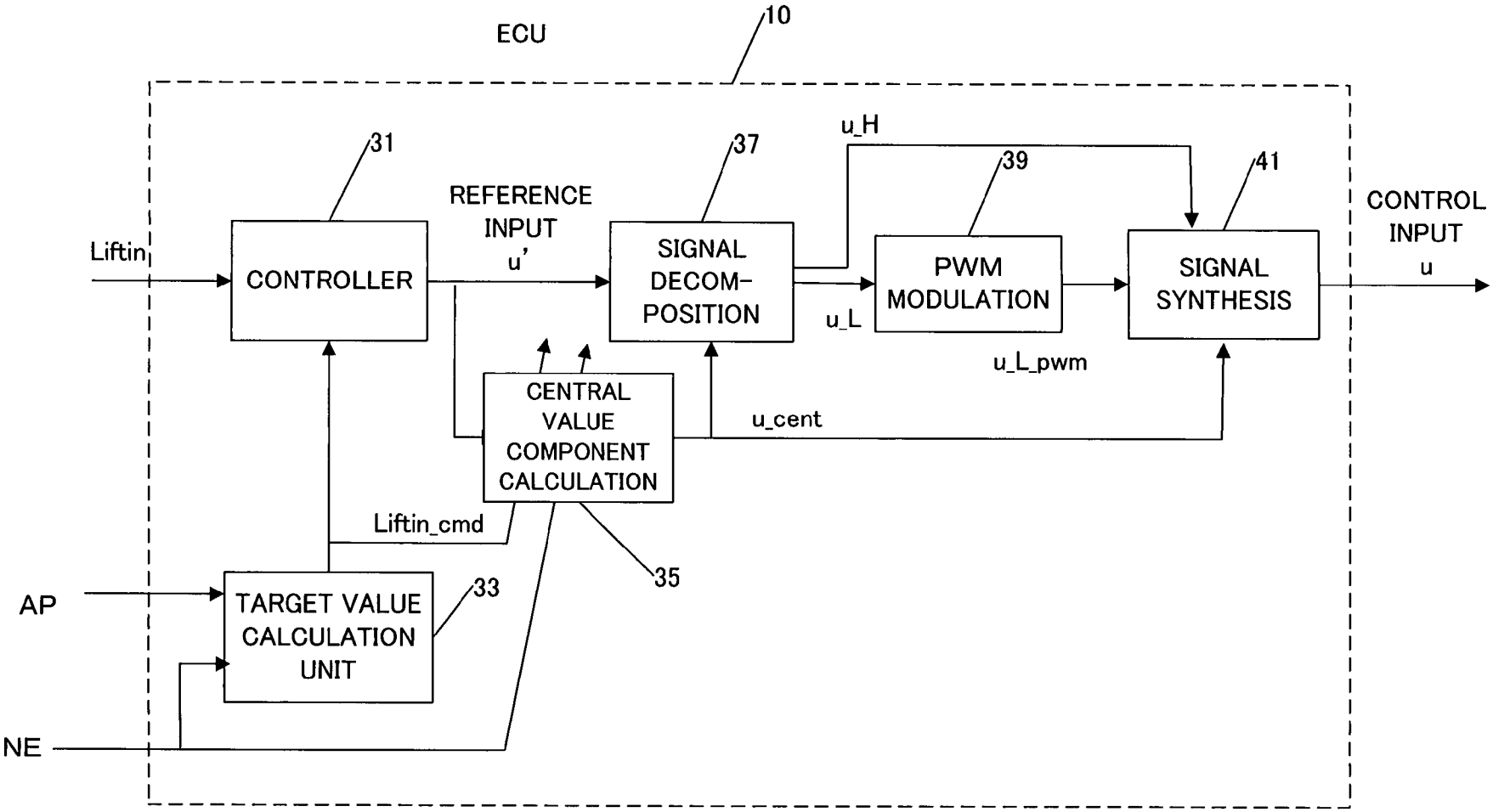
FIG. 4 is a block diagram of a controller for a variable lift system according to the embodiment.

FIG. 4 illustrates a block diagram of a control system for the variable lift system 19 to one embodiment. The control system is typically an ECU 10.

A controller 31 calculates control input u' for the lift amount Liftin of the intake valve 12 such that it converges to a target value Liftin_cmd (hereinafter referred to as "reference input"). In this embodiment, the sliding mode control with two-degree-of-freedom is used to determine reference input u'. The sliding mode control with two-degree-of-freedom can separately specify the convergence speed of deviation with respect to the target value and the convergence speed when disturbance is applied to the controlled object. Details on the sliding mode control with two-degree-of-freedom can be found in Patent Document 1. The controller 31 may also employ any known control method other than the sliding mode control with two-degree-of-freedom.

A target value calculation unit 33 calculates target value Liftin_cmd for the lift amount of the intake valve 12. The unit 33 calculates target value Lifin_cmd based on an opening degree of the acceleration pedal AP and the number of engine rotations NE and referring to a map stored in the memory 10*c* of the ECU 10.

Figure 5:
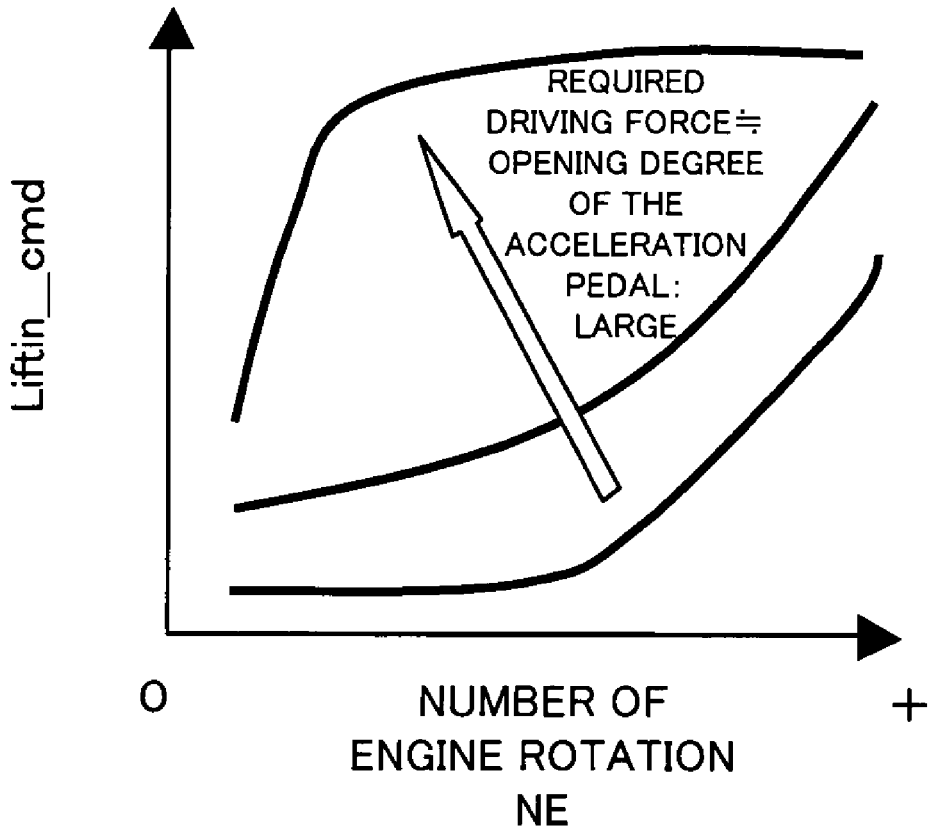
FIG. 5 shows a map for calculating lift amount target value Liftin_CMD.

FIG. 5 illustrates an example of the map for calculating target value Liftin_cmd for the lift amount. The horizontal axis of the graph represents the number of engine rotation NE and the vertical axis of the graph represents target value of lift amount Liftin_cmd. The lift amount target value Liftin_cmd assumes a larger value as the number of engine rotation NE increases. Also, the lift amount target value Liftin_cmd assumes a larger value as a required driving force (typically represented by the opening degree of the acceleration pedal) becomes larger.

Referring to FIG. 4 again, a central value component calculation unit 35 extracts central value component u_cent, the central value of the reference input u' in the variation range. It is required that central value component u_cent does not follow impulse-like behavior or variation of small amplitude of reference input u' (Condition 1) and does follow a large variation such as step waveform of reference input (Condition 2). Condition 1 is for increasing convergence of control and condition 2 is for enhancing ability-to-follow of the control.

Condition 1 and Condition 2 are contradictory and cannot be satisfied by a general linear filter. This is because, if high-frequency components such as impulse wave forms and minute oscillation are removed by a linear filter (Condition 1), the shape of step waveform is also smoothed, or reversely, if a large variation such as step waveform is maintained (Condition 2), high-frequency components may not completely be removed.

Accordingly, in this embodiment, the central value component u_cent is extracted by applying a non-linear filter represented by the following formula:

$$\mathrm{u_cent}(k) = \begin{cases} \mathrm{u_cent}(k-1)+\varepsilon\max(k): & \varepsilon\max(k) \le \mathrm{du_cent}(k) \\ \mathrm{u_cent}(k-1)+\mathrm{du_cent}(k): & -\varepsilon\max(k) < \mathrm{du_cent}(k) < \varepsilon\max(k) \\ \mathrm{u_cent}(k-1)-\varepsilon\max(k): & \mathrm{du_cent}(k) \le -\varepsilon\max(k) \end{cases} \tag{3}$$

Here, k represents a time step. Du_cent(k) is the deviation or difference between the current reference input u'(k) and the central value component u_cent(k−1) and is represented by the following formula:

$$du_\mathrm{cent}(k)=u'(k)-u_\mathrm{cent}(k-1) \tag{4}$$

ϵmax(k) is a rate limit value for rate limit processing, represented by the following formula:

$$\epsilon\max(k)=\mathrm{MAX}(\epsilon d(k), \epsilon r(k)) \tag{5}$$

where MAX( ) is maximum value function and larger one of ϵd(k) and ϵr(k) is selected.

ϵd(k) and ϵr(k) are parameters relating to Condition 1 (i.e., convergence of control) and Condition 2 (i.e., follow-ability of control). These parameters are updated as appropriate with application of disturbance and/or variation of the target value Liftin_cmd, serving as an index for determining which of the conditions is significant at present. ϵd(k) and ϵr(k) are found from the map shown in FIG. 6 based on variables Fd and Fr that are determined from the following formulas:

$$Fd(k)=(1-Kd)Fd(k-1)+Kd(NE(k)-NE(k-1)) \quad (6)$$

$$Fr(k)=(1-Kr)Fr(k-1)+Kr(Liftin_cmd(k)-Liftin_cmd(k-1)) \quad (7)$$

where Kd and Kr are filter constants, 0<Kd<1, 0<Kr<1.

Formula (6) produces variable Fd that varies with disturbance. In this embodiment, the number of engine rotation NE is used as a parameter that has high correlation with disturbance. Responsive to the number of engine rotation NE, control input u for bringing the lift amount Liftin at the target value Liftin_cmd assumes different values. Thus, variation of the number of engine rotation NE is considered to be a disturbance to the control system of the variable lift system. From Formula (6), variable Fd assumes a larger value as variation of the number of engine rotation NE becomes larger.

Formula (7) produces variable Fr that varies with the lift amount target value Liftin_cmd. From Formula (7), variable Fr assumes a larger value as variation of the lift amount target value Liftin_cmd becomes larger.

Figure 6:
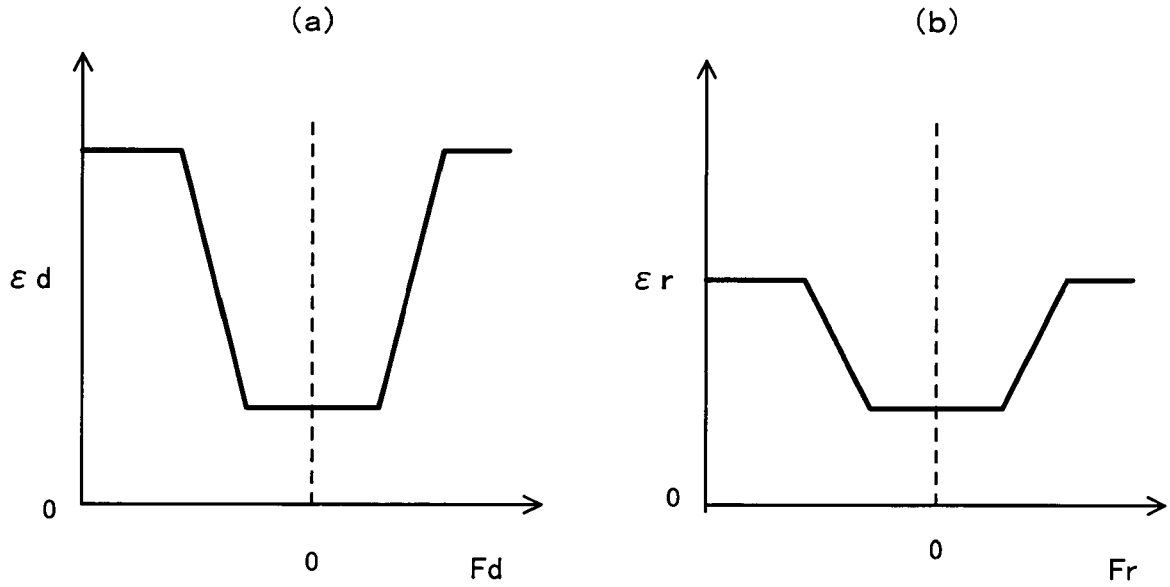
FIG. 6 shows behaviour of parameters $\epsilon d$ and $\epsilon r$ based on variables Fd and Fr.

FIG. 6(*a*) illustrates a behaviour of parameter ϵd responsive to variable Fd that is determined by Formula (6). The horizontal axis of the graph represents variable Fd and the vertical axis represents parameter ϵd. From Formula (6), variable Fd is a parameter that increases and decreases in proportion to variation of the number of engine rotation NE.

Referring to FIG. 6(*a*), when large variation occurs to the number of engine rotation NE and the absolute value |Fd| of the variable Fd exceeds a predetermined value, the parameter ϵd increases in proportion to |Fd|. After it reaches a predetermined maximum value, the parameter ϵd assumes the predetermined maximum value even if |Fd| becomes larger. At this point, the non-linear filter of Formula (3) has a large value for the limit value ϵmax, so it can maintain large variation such as step waveform so that the filter is oriented to Condition 2 (i.e., following ability of control) mentioned above.

When variation in the number of engine rotation NE is small and |Fd| is below a predetermined value, the parameter ϵd assumes a predetermined minimum value. The non-linear filter of Formula (3) has a small value for the limit value ϵmax at this point, so that it can eliminate high-frequency components such as impulse waveform and minute oscillation so that the filter is oriented to Condition 1 (convergence of control) described above.

FIG. 6(*b*) illustrates behaviour of parameter ϵr based on variable Fr that is determined by Formula (7). The horizontal axis of the graph represents variable Fr and the vertical axis of the graph represents parameter ϵr. From Formula (7), variable Fr is a parameter that increases and decreases in proportion to the variation of the lift amount target value Liftin_cmd.

Referring to FIG. 6(*b*), when a large variation occurs to the lift amount target value Liftin_cmd and the absolute value |Fr| of variable Fr exceeds a predetermined value, the parameter ϵr increases in proportion to |Fr|. After reaching a predetermined maximum value, the parameter ϵr assumes the predetermined maximum value regardless of increase of |Fr|. At this time, the non-linear filter of Formula (3) has a large value for the limit value ϵmax, so that it can maintain large variations such as step waveform so that the filter is oriented to Condition 2 (i.e., following ability of control).

When variation in the lift amount target value Liftin_cmd is small and |Fr| is below a predetermined value, the parameter ϵr assumes a predetermined minimum value. At this time, the non-linear filter of Formula (3) has small value for the limit value ϵmax, so that it can remove high-frequency components such as impulse waveform or minute oscillation so that the filter is oriented to Condition 1 (convergence of control).

Referring to FIG. 6(*a*) with (*b*), the maximum value of the parameter ϵd is set to be larger than that of the parameter ϵr. This is because, when disturbance such as variation in the number of engine rotation NE is applied, variations in the reference input u' from the controller 31 is larger and the range of variation of the signal to be maintained by the non-linear filter is larger.

The central value component u_cent produced by the central value component calculation unit 35 is input to a signal decomposition unit 37 and a signal synthesis unit 41.

The signal decomposition unit 37 divides reference input a' into three components as indicated by the arrow A in FIG. 3 and Formula (1).

Figure 7:
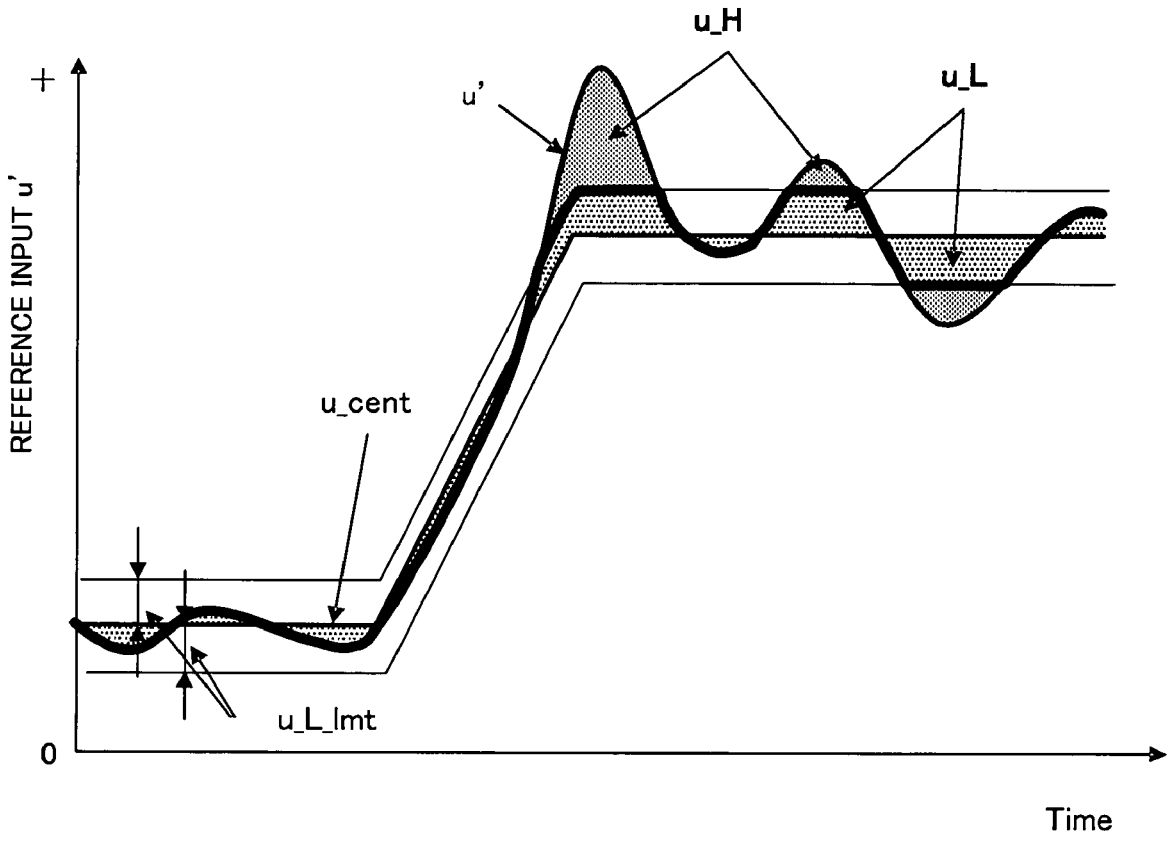
FIG. 7 illustrates the relationship between small variation component u_L and large variation component u_H relative to reference input u'.

FIG. 7 illustrates the relationship between the small variation component u_L and the large variation component u_H relative to the reference input a'. The central value component u_cent is first calculated relative to the reference input u' and the difference u" between them is determined. Then, out of difference u", the reference input signal in the range of a predetermined division threshold value u_L_lmt is extracted as the small variation component u_L. Signal component exceeding the division threshold value is extracted as the large variation component u_H.

In this embodiment, the small variation component u_L and the large variation component u_H are calculated by Formulas (8) to (10).

$$u''(k) = u(k) - \text{u_cent}(k) \quad (8)$$

$$\text{u_L}(k) = \begin{cases} \text{u_L_lmt} & (\text{u_L_lmt} \le u''(k)) \\ u''(k) & (-\text{u_L_lmt} < u''(k) < \text{u_L_lmt}) \\ -\text{u_L_lmt} & (u''(k) \le -\text{u_L_lmt}) \end{cases} \quad (9)$$

$$\text{u_H}(k) = \begin{cases} u''(k) - \text{u_L_lmt} & (\text{u_L_lmt} \le u''(k)) \\ 0 & (-\text{u_L_lmt} < u''(k) < \text{Du_L_lmt}) \\ u''(k) + \text{u_L_lmt} & (u''(k) \le -\text{u_L_lmt}) \end{cases} \quad (10)$$

The small variation component u_L produced at the signal decomposition unit 37 is input to the PWM modulation unit 39. The large variation component u_H is input to the signal synthesis unit 41.

Figure 8:
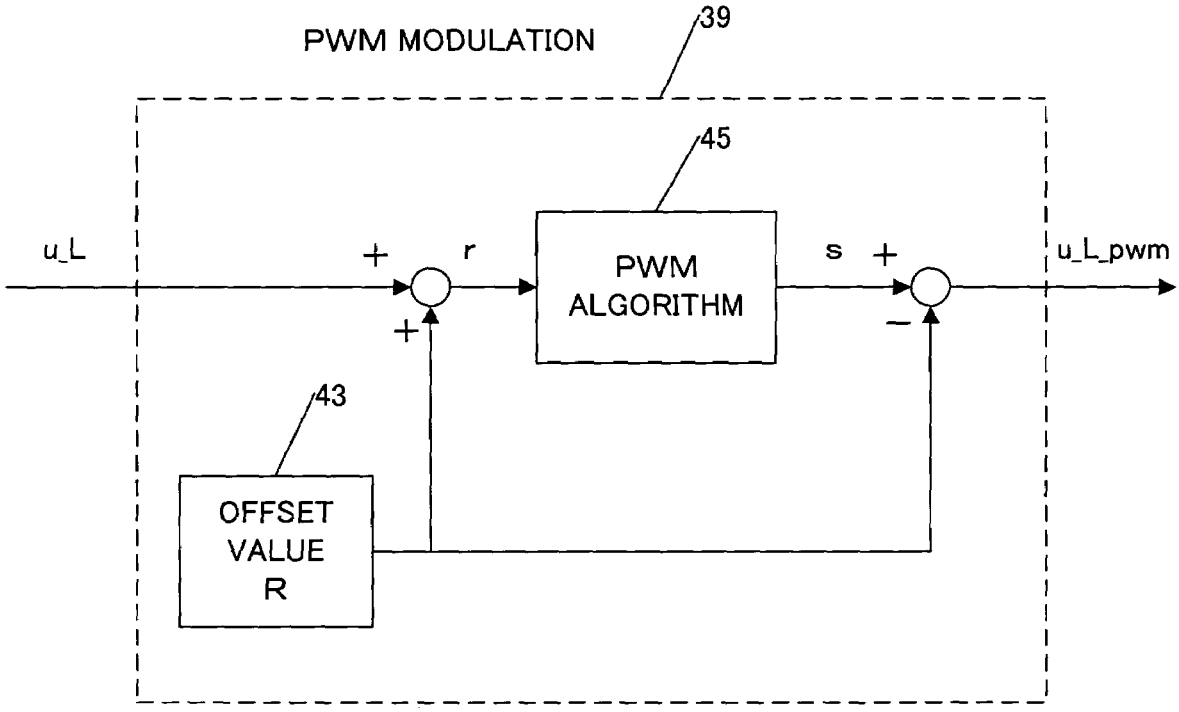
FIG. 8 is a block diagram showing modulation process at a PWM modulation unit.

The PWM modulation unit 39 PWM-modulates the small variation component u_L of the reference input a' and produces PWM-modulated small variation component u_L_pwm. FIG. 8 is a block diagram illustrating modulation process at the PWM modulation unit 39.

The PWM modulation unit 39 first performs offsetting process by adding an offset value R to the small variation component u_L.

$$r(k)=u_L(k)+R \quad (11)$$

where the offset value R is a value greater than the division threshold value u_L_lmt used at the signal decomposition unit 37, 0<u_L_lmt≦R. The offset value R is half of the PWM modulation amplitude amount MAMP.

Subsequently, PWM algorithm 45 is executed. The PWM algorithm 45 produces s(k) using Formulas (12) to (15).

$$\text{Rate_r}(k) = \frac{r(k)}{MAMP} \quad (12)$$

-continued $$\text{Rate_tm}(k) = \frac{\text{Tm_m}(k)}{MPRD} \tag{13}$$

$$\text{Tm_m}(k) = \begin{cases} \text{Tm_m}(k-1) + \Delta T & (MPRD \geq \text{Tm_m}(k-1) + \Delta T) \\ 0 & (MPRD < \text{Tm_m}(k-1) + \Delta T) \end{cases} \tag{14}$$

$$s(k) = \begin{cases} MAMP & (\text{Rate_r}(k) \leq \text{Rate_tm}(k) \\ 0 & (\text{Rate_r}(k) > \text{Rate_tm}(k) \end{cases} \tag{15}$$

Here, MAMP is PWM amplitude (>0), MPRD is PWM perio width (>0), and ΔT is control cycle (e.g., 5 ms).

Finally, the PWM modulation unit 39 subtracts offset value R from output s(k) of the PWM algorithm and brings back offsetting process to produce u_L_pwm.

$$u_L_pwm(k)=s(k)-R \tag{16}$$

Returning to FIG. 4, the signal synthesis unit 41 sums central value component u_cent, large variation component u_H, and PWM-modulated small variation component u_L_pwm of the reference input as represented by Formula (2) to produce the control input u to the variable lift system 19. The control input u is passed to the variable lift system 19.

Figure 9:
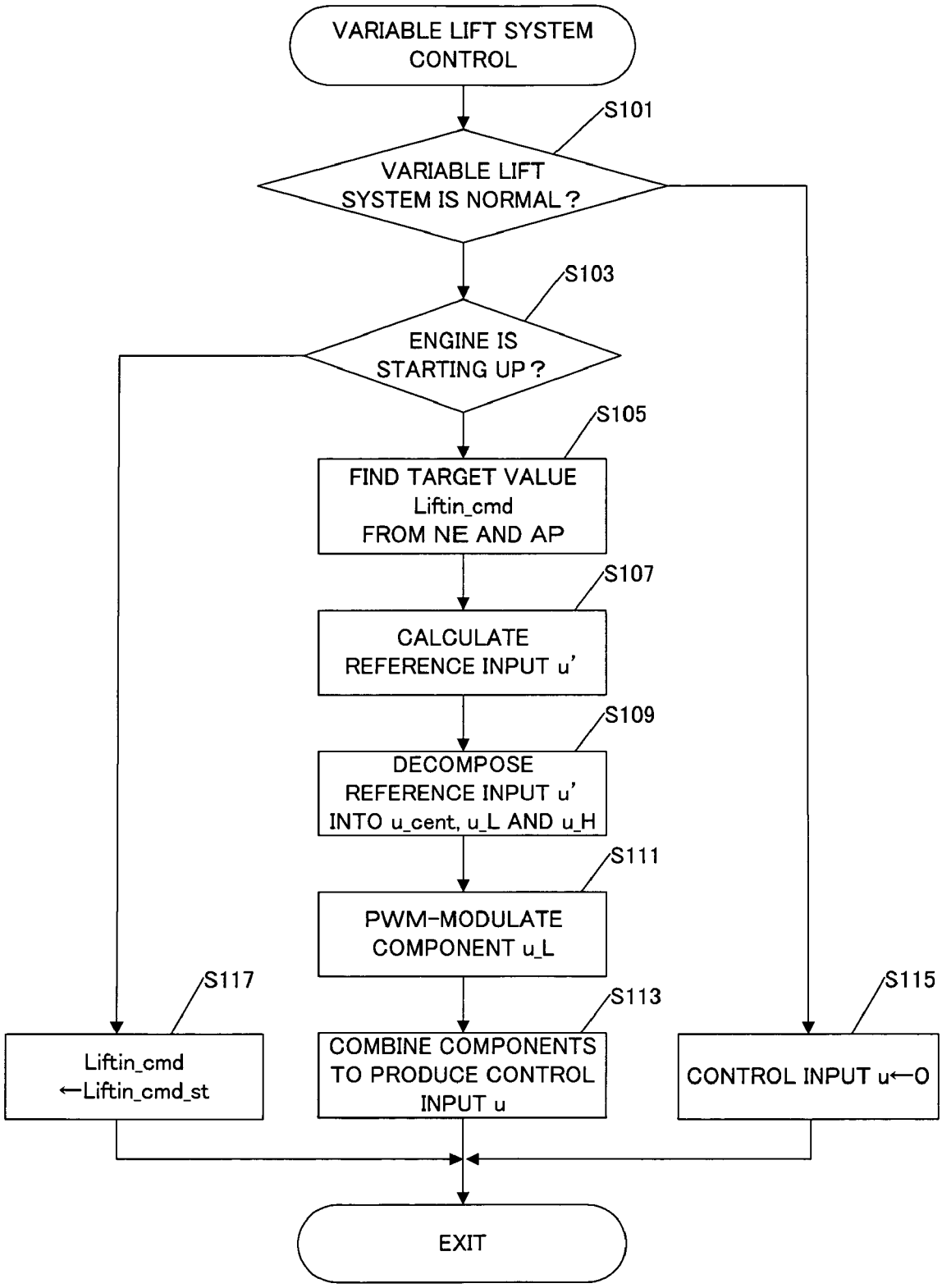
FIG. 9 is a flowchart showing a process of controlling the variable lift system according to the embodiment.

FIG. 9 is a flowchart of a process of controlling the variable lift system 19 according to the embodiment. This process is executed at a predetermined time interval (5 ms, for example).

At step S101, whether or not the variable lift system 19 is normal is determined. For example, reference is made to determination result of abnormality detection process performed by the ECU 10 in parallel with this flowchart. If it is confirmed that the variable lift system 19 is operating normally, the procedure proceeds to step S103. However, if some abnormality is observed with the variable lift system 19, the procedure proceeds to step S115, where the control input u is set to 0 and the process is terminated. When the control input u=0, a lift of about 2 mm is maintained by a default mechanism.

At step S103, it is checked if the engine 11 is starting up. If the engine 11 is in a normal drive condition, the procedure proceeds to step S105. If the engine 11 is starting up, the procedure proceeds to step S117, where the lift amount target value Liftin_cmd is set to value Liftin_cmd_st that is smaller than normal driving condition (e.g., 0.8 mm) for enhancing flow in the cylinders.

At step S105, the target value Liftin_cmd of the lift amount is determined. Target value Liftin_cmd is calculated from the map shown in FIG. 5, for example, based on the number of engine rotations NE and the opening degree of the acceleration pedal AP.

At step S107, the controller 31 calculates the reference input u' to the variable lift system 19. The reference input u' is determined from the lift amount Liftin and the lift amount target value Liftin_cmd for the intake valve 12 by means of a known control method such as the sliding mode control with two-degree-of-freedom such that the lift amount Liftin approaches the target value Liftin_cmd.

At step S109, the reference input u' is divided into three components, the central value component u_cent, the small variation component u_L, and the large variation component u_H. First, the central value component u_cent is determined using Formulas (3) to (7). Then, the small variation component u_L and the large variation component u_H are determined using Formulas (8) to (10).

At step S111, the small variation component u_L is PWM-modulated. The small variation component u_L is PWM modulated using Formulas (11) to (16) to produce PWM-modulated small variation component u_L_pwm.

At step S113, the central value component u_cent, the PWM-modulated small variation component u_L_pwm and the large variation component u_H are summed to produce control input u to the variable lift system.

Figure 10:
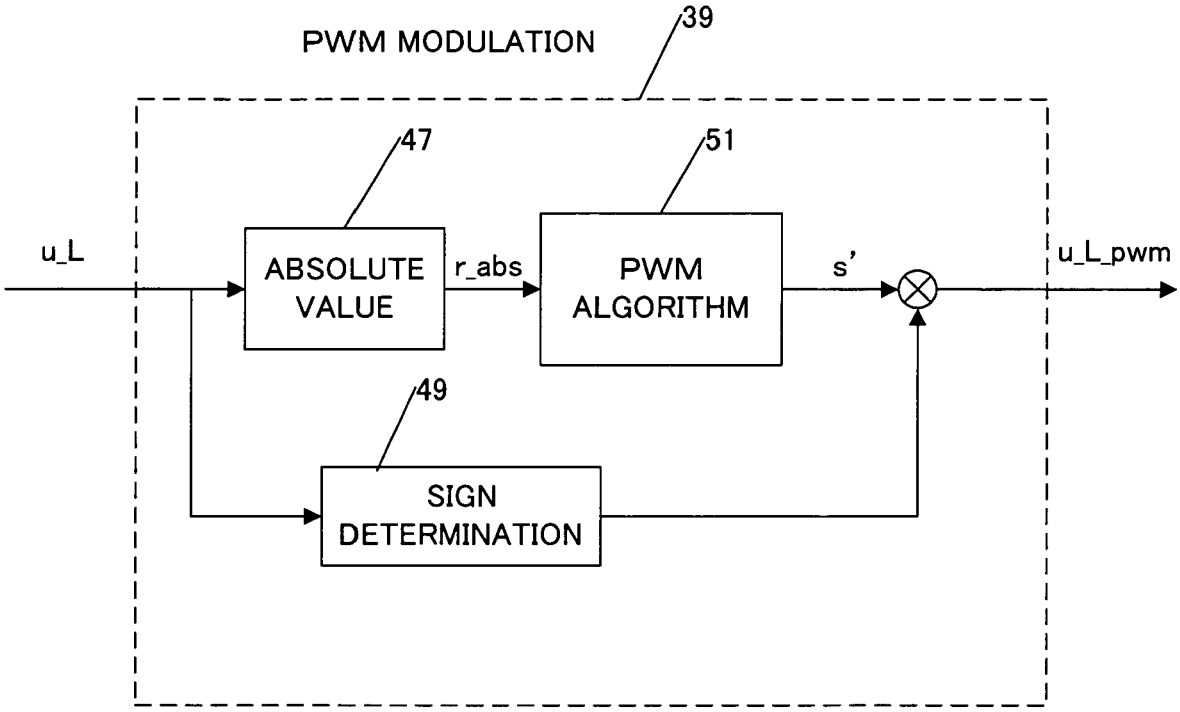
FIG. 10 is a block diagram showing modulation process at a PWM modulation unit in another embodiment of the invention.

As a derivative manner of the embodiment, an embodiment in which the configuration of the PWM modulation unit 39 of FIG. 4 may be modified as illustrated in FIG. 10. In this embodiment, the PWM modulation unit 39 determines whether the small variation component u_L is positive or negative without performing offsetting process and multiplies the modulated component by the determined sign to produce a modulated component u_L_pwm.

In FIG. 10, the PWM modulation unit 39 first determines the absolute value r_abs of the small variation component u_L (block 47).

$$r_abs(k)=abs(u_L(k)) \tag{17}$$

Subsequently, the PWM algorithm 51 is performed. The PWM algorithm 51 produces s'(k) from r_abs(k) using Formulas (18) to (21).

$$\text{Rate_r}(k) = \frac{\text{r_abs}(k)}{MAMP'} \tag{18}$$

$$\text{Rate_tm}(k) = \frac{\text{Tm_m}(k)}{MPRD'} \tag{19}$$

$$\text{Tm_m}(k) = \begin{cases} \text{Tm_m}(k-1) + \Delta T & (MPRD' \geq \text{Tm_m}(k-1) + \Delta T) \\ 0 & (MPRD' < \text{Tm_m}(k-1) + \Delta T) \end{cases} \tag{20}$$

$$s'(k) = \begin{cases} MAMP' & (\text{Rate_r}(k) \leq \text{Rate_tm}(k) \\ 0 & (\text{Rate_r}(k) > \text{Rate_tm}(k) \end{cases} \tag{21}$$

where MAMP' is PWM amplitude (>0), MPRD' is PWM period width (>0), and ΔT is control cycle (e.g., 5 ms).

Finally, the PWM modulation unit 39 multiplies the output s'(k) of the PWM algorithm 51 by a sign that is determined by a sign determination unit 49 using sgn function to produce u_L_pwm.

$$u_L_pwm(k)=s'(k)sgn(u_L(k)) \tag{22}$$

The bypass PWM algorithm of the present invention can be applied to a plant having a high non-linear property in addition to the variable lift system.

Figure 11:
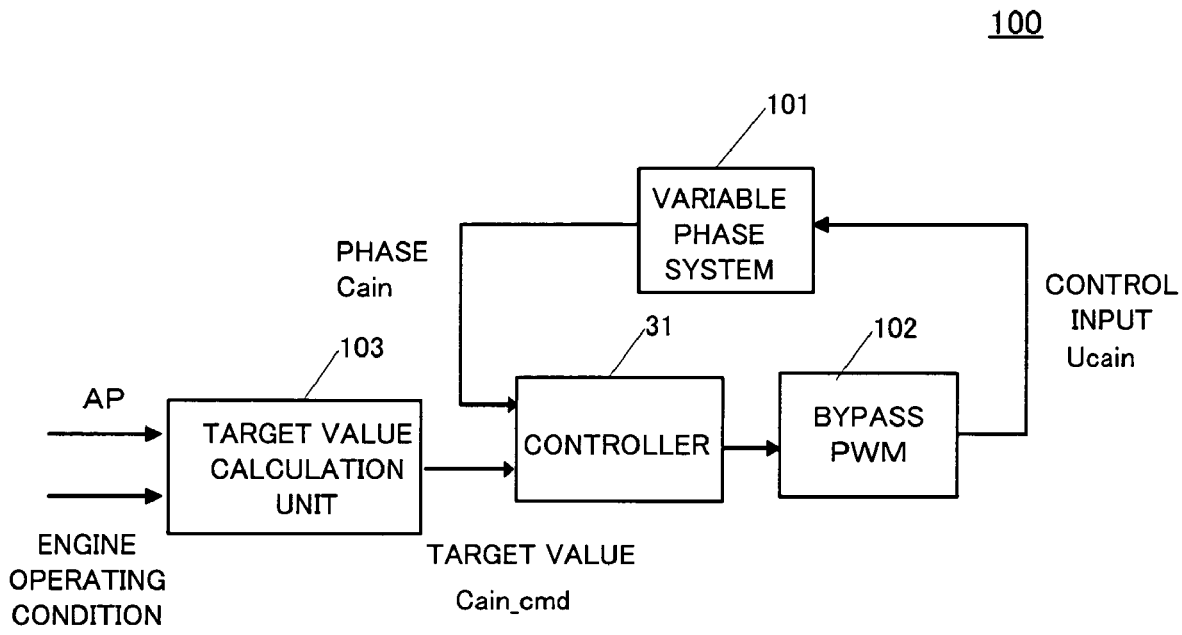
FIG. 11 is a block diagram of a control system that applies bypass PWM algorithm to a variable phase system.

FIG. 11 is a block diagram of a control system 100 that applies bypass PWM algorithm to a variable phase system 101. A bypass PWM unit 102 is a control block that includes only the central value component calculation unit 35, signal decomposition unit 37, PWM modulation unit 39, and signal generation unit 41 of FIG. 4. The variable phase system 101 controls valve timing by varying cam phase Cain using a hydraulic and/or an electromagnetic brake. In this case, controllability of phase Cain may be improved because the modulation range can be decreased as compared to a conventional modulator while hysteresis property of a hydraulic solenoid or an electromagnetic brake and a low control resolution involved are compensated by the modulation input.

Figure 12:
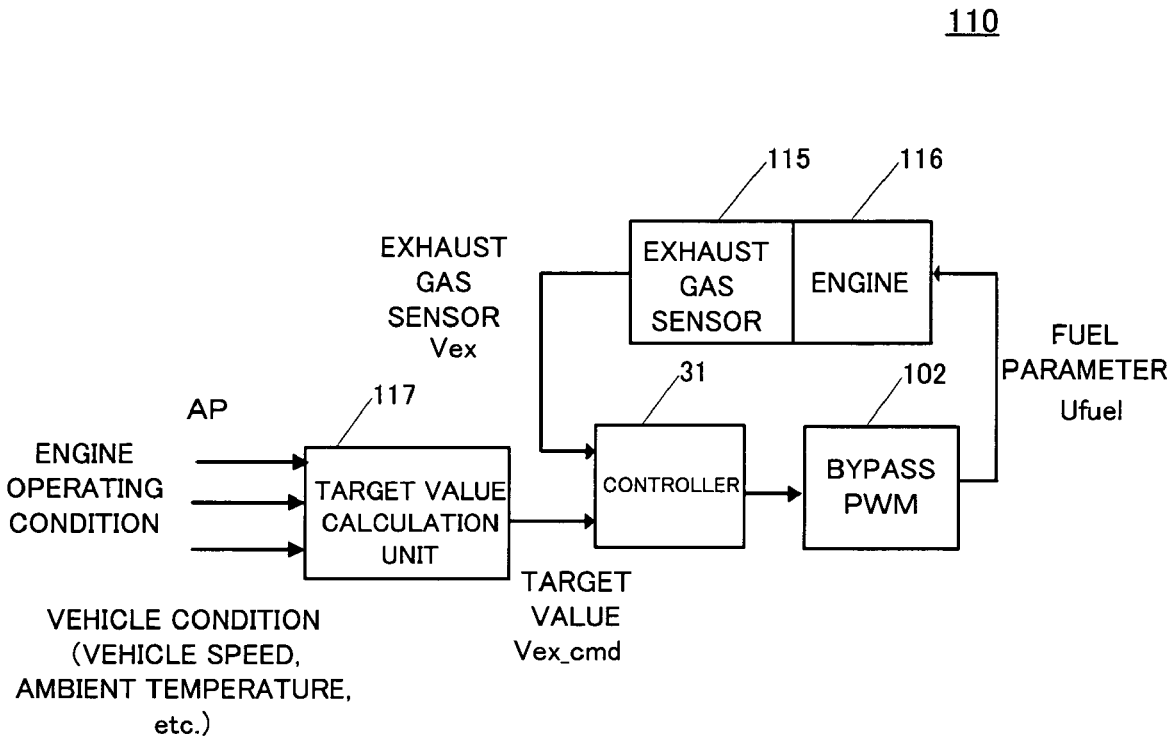
FIG. 12 is a block diagram of a system that applies bypass PWM algorithm to air-fuel ratio control.

FIG. 12 is a block diagram of a system 110 that applies bypass PWM algorithm to air-fuel ratio control. A bypass PWM unit 102 is identical to that of FIG. 11. The air-fuel ratio control system 110 controls output Vex of an exhaust gas sensor 115 attached to the exhaust system of an engine 116 to target value Vex_cmd through adjustment of fuel parameter Ufuel (e.g., fuel correction amount). In this case, response delay or variations of the engine 116 and/or catalyst can be compensated and exhaust gas sensor output Vex can be controlled to target value Vex_cmd, reducing hazardous substances in the exhaust gas. In addition, by reducing variation range of fuel parameter Ufuel, a control input, combustion variation in the engine 116 is reduced, thereby reducing unburned HC (hydrocarbon).

Figure 13:
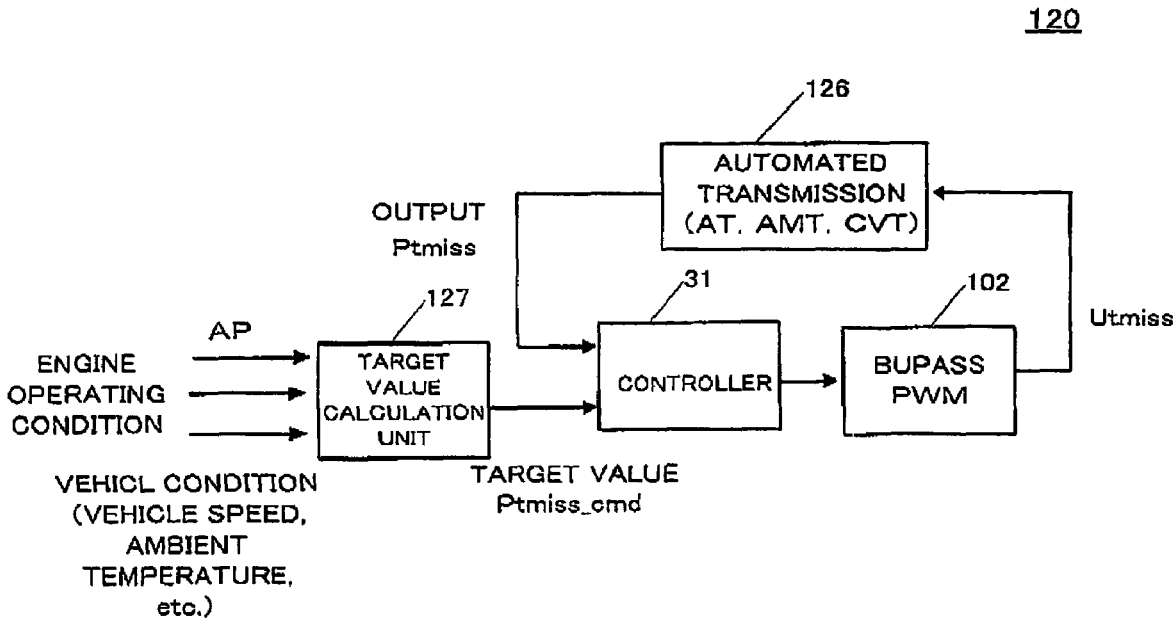
FIG. 13 is a block diagram of a system that applies bypass PWM algorithm to actuator control of an automatic transmission.

FIG. 13 is a block diagram of a system 120 that applies bypass PWM algorithm to actuator control of an automated transmission 126. The bypass PWM unit 102 is identical to that in FIG. 11. Actuator control of the automated transmission 126 can include positioning control of a hydraulic or electric actuator for controlling a clutch or a shift lever of an AMT (Automated Manual Transmission), engaging and detaching of a hydraulic multiple disc clutch for an AT (Automatic Transmission), slip ratio control, and lateral pressure control of a belt CVT (Continuously Variable Transmission). For these controls, a high controllability is hard to achieve due to friction and/or hysteresis characteristic of the automatic transmission system 126 and/or an actuator. Accordingly, by applying bypass PWM algorithm as in FIG. 13, a high controllability and improvement of gas mileage may be achieved as shocks at gear shifting or speed change are reduced, resulting in improvement of transmission efficiency.

While the invention has been described with respect to particular embodiments, the invention is not limited to those embodiments.

What is claimed is:

1. A control system for a plant, comprising:

means for calculating provisional control input for controlling output of said plant at a target value;

means for dividing said provisional control input into a plurality of components;

means for PWM-modulating at least one of said components; and means for summing said PWL-modulated component and other components to produce a control input to said plant, wherein said plurality of components comprises:

a first component produced by filtering said provisional control input; and a second component that is a difference between said provisional control input and said first component, said second component being within a predetermined absolute value range and PWM-modulated.

2. The control system according to claim 1, wherein said first component has a variation amount within a predetermined range and the predetermined range is changed in accordance with the variation amount of said target value.

3. The control system according to claim 2, wherein said first component is limited to have a variation amount within a predetermined range and the predetermined range is changed in accordance with the variation amount of disturbance.

4. The control system according to claim 1, wherein said PWM modulation means offsets said at least one of said components to be PWM modulated in a predetermined direction, PWM-modulates the offset component, and offsets the PWM-modulated component in a reverse direction.

5. The control system of claim 1, wherein said plant is a variable lift system of an internal combustion engine, and wherein said provisional control input is calculated for controlling a maximum lift amount of said variable lift system at a target lift amount.

6. The control system of claim 1, wherein said plant is a variable phase system of an internal combustion engine, and wherein said provisional control input is calculated for controlling a cam phase of said variable phase system at a target phase.

7. The control system of claim 1, wherein said plant is an air-fuel ratio controller of an internal combustion engine, and wherein said provisional control input is calculated for controlling exhaust gas sensor output at a target value.

8. The control system of claim 1, wherein said plant is an automatic transmission of an internal combustion engine, and wherein said provisional control input is calculated for controlling output position of the automatic transmission at a target position.

9. A method for controlling a plant using a PWM algorithm, comprising:

calculating provisional control input for controlling output of said plant at a target value;

dividing said provisional control input into a plurality of components;

PWM-modulating at least one of said plurality of components; and summing said PWL-modulated component and other components to produce a control input to said plant, wherein said plurality of components comprises:

a first component produced by filtering said provisional control input; and a second component that is a difference between said provisional control input and said first component, said second component being within a predetermined absolute value range and PWM-modulated.

10. The method according to claim 9, wherein said first component has a variation amount within a predetermined range and the predetermined range is changed in accordance with the variation amount of said target value.

11. The method according to claim 10, wherein said first component has a variation amount within a predetermined range and the predetermined range is changed in accordance with the variation amount of disturbance.

12. The method according to claim 9, wherein said PWM modulation offsets said at least one of said components to be PWM modulated in a predetermined direction, PWM-modulates the offset component, and offsets the PWM-modulated component in a reverse direction.

13. The method of claim 9, wherein said plant is a variable lift system of an internal combustion engine, and wherein said provisional control input is calculated for controlling a maximum lift amount of said variable lift system at a target lift amount.

14. The method of claim 9, wherein said plant is a variable phase system of an internal combustion engine, and wherein said provisional control input is calculated for controlling a cam phase of said variable phase system at a target phase.

15. The method of claim 9, wherein said plant is an air-fuel ratio controller of an internal combustion engine, and wherein said provisional control input is calculated for controlling exhaust gas sensor output at a target value.

16. The control system of claim 9, wherein said plant is an automatic transmission of an internal combustion engine, and wherein said provisional control input is calculated for controlling output position of the automatic transmission at a target position.

17. A computer executable program stored in a computer readable medium for controlling a plant using a PWM algorithm, said program when executed performs: calculating provisional control input for controlling output of said plant at a target value;

dividing said provisional control input into a plurality of components;

PWM-modulating at least one of said plurality of components; and summing said PWL-modulated component and other components to produce a control input to said plant, wherein said plurality of components comprises:

a first component produced by filtering said provisional control input: and a second component that is a difference between said provisional control input and said first component, said second component being within a predetermined absolute value range and PWM-modulated.

* * * * *